United States Patent [19]

Hinz et al.

[11] 4,390,997

[45] Jul. 5, 1983

[54] HEAT PROTECTION GARMENT

[75] Inventors: Claus-Dieter Hinz, Lübeck; Adalbert Pasternack, Bad Schwartau, both of Fed. Rep. of Germany

[73] Assignee: Drägerwerk Aktiengesellschaft, Fed. Rep. of Germany

[21] Appl. No.: 225,656

[22] Filed: Jan. 16, 1981

[30] Foreign Application Priority Data

Feb. 2, 1980 [DE] Fed. Rep. of Germany ..... 3004593

[51] Int. Cl.[3] ..... A41D 13/00

[52] U.S. Cl. ..... 2/81; 2/7; 2/2.1 A; 165/153; 165/159

[58] Field of Search ..... 2/7, 81, 253, 413, 2.1 A, 2/2.1 R; 165/46, 153, 159; 126/204, 208, 263

[56] References Cited

U.S. PATENT DOCUMENTS 3,348,236 10/1967 Copeland ..... 2/81
3,744,053 7/1973 Parker et al. ..... 2/2.1 R
4,172,495 10/1979 Zebuhr et al. ..... 2/413

FOREIGN PATENT DOCUMENTS 56-25687 12/1981 Japan ..... 165/46

*Primary Examiner*—Werner H. Schroeder
*Assistant Examiner*—Steven N. Meyers
*Attorney, Agent, or Firm*—McGlew and Tuttle

[57] ABSTRACT

A heat protection garment comprises one or more manifolds connected to one or more headers by a plurality of parallel extending coolant tubes. The manifolds and headers are similar and both include mixing chambers to which the coolant tubes are connected. Coolant supply and discharge conduits are connected to the manifolds and headers respectively with connecting pieces extending across the mixing chambers between the coolant tubes and the conduits, in a plurality of rows. The ratio between the spacing of the parallel rows to the length of each of the connecting pieces to the distance between each of the connecting pieces in each of the rows is approximately smaller or equal to 1:3:1 and the number of coolant tubes to the number of rows of connecting pieces to the number of conduits connected to each mixing chamber is smaller than or equal to about 12:3:1.

6 Claims, 2 Drawing Figures

HEAT PROTECTION GARMENT

FIELD AND BACKGROUND OF THE INVENTION

The present invention relates in general to heat protection garments and in particular to a new and useful heat protection garment which includes manifolds and headers which are connected by a plurality of coolant tubes.

By metabolism the human body generates heat continuously. The heat is normally given off into the surroundings by radiation, conduction, convection and evaporation. The necessary equilibrium at which the body temperature does not rise beyond the physiologically permitted limit can be achieved only if the surroundings can absorb the heat as quickly as it is generated. Direct removal of heat from the body becomes impossible, however, when the surrounding temperature is higher than the permissible upper limit for human body temperature. In these cases the heat is removed by a cooling system in which a cooling liquid or gas is passed through pipes. For reasons of health and wearing comfort it is extremely important that the coolant quantity is distributed over the entire cooling surface. If this were not the case, partial supercooling and possibly health damage could result.

A known heat protection suit is used for work in mines under hazardous conditions when the temperature reaches, for instance, 150° C. and where there are poisonous gases or no oxygen in the surrounding atmosphere.

The protective suit consists of an elastic fabric. Additionally it is completely covered with a heat-insulating three-layer covering. Externally of the protective suit, but inside the covering, pipes are fastened which likewise consist of an elastic material. They serve as paths to circulate the cooling medium. The individual pipes are joined through a header to form a complete pipe system. For this purpose the ends of the pipes are connected to this header. The header is a tubular ring attached to the helmet of the protective suit, the cavity of the ring being divided into two chamber portions by dividing walls. The coolant medium is supplied to one chamber portion and discharged from the other. For the passage of the cooling medium through the pipes, the pipes are connected by their two ends to the chamber portions. The header is connected with the cooling system by appropriate flexible tubes. The cooling medium circulates and absorbs or gives off heat. The distribution of the cooling medium over the individual pipes and hence the cooling of the body surface, depends on the arrangement of the ends of the pipes at the header and the resulting flow conditions. Through a pipe connected to the header near the feed tube from the cooling system a different quantity of cooling medium will flow than through a pipe connected diametrically opposite thereto (see DE-PS No. 24 19 524).

Another protective garment is known which has liquid-traversed tubes for heat transfer. These tubes have a liquid feed line and a return line. In order to hinder the wearer of the protective garment as little as possible in his freedom of movement, the tubes are flexibly mounted singly or in groups in holding means consisting of channels. The holding means consist of holding strips sewed to the garment which are made of the same material as the rest of the garment. The holding strips form a channel in which the tube is freely movable. The liquid feed line branches into individual tubes leading to the arm and leg ends and ending there in distribution pieces. Thence return tube groups lead in the form of large-area spirals along the body to the center of the body and end there in return collecting segments. The return collecting segments then have connecting lines and lastly are connected to the return line for the heat-transfering liquid. The division or combination of the heat-transfering liquid in the distributor segments and in the return collecting segments occurs according to the geometric arrangement thereon. The quantity of liquid in the tubes is thus dependent on the geometry of the segments. A uniform control of the various body portions is not ensured (see DE-AS No. 16 10 647).

SUMMARY OF THE INVENTION

An object of the present invention is to ensure that equal quantities of coolant will flow through the parallel-connected tubes, channels or pipes.

Accordingly, another object of the present invention is to provide a heat protection garment comprising, at least one manifold having walls defining a mixing chamber, at least one header having walls defining a mixing chamber, a plurality of coolant tubes connecting the manifold and header mixing chambers, at least one coolant supply conduit connected to the manifold mixing chamber at a location spaced from the coolant tubes, at least one coolant discharge conduit connected to the header mixing chamber at a spaced location from the coolant tubes, and a plurality of parallel rows of connecting pieces extending across the manifold and header mixing chambers between the coolant tubes and the coolant conduits respectively. The ratio, in each of the manifold and header, of a number of coolant tubes to the number of rows of connecting pieces to the number of coolant conduits being approximately 12 to 3 to 1. With the ratio in each of the manifold and header of the distance between adjacent parallel rows to the length of each connecting piece of each row to the spacing between each connecting piece in each row being approximately equal to 1 to 3 to 1.

Another object of the invention is to provide such a garment wherein the walls defining the mixing chambers in the header and manifold include at least two opposite parallel walls, the conduit tubes connected to one of these opposite walls and the at least one coolant conduit connected to the other of the opposite walls and extending parallel thereto.

This advantageous and simple solution assures uniform flow through all coolant tubes. The design of the mixing chamber according to the stated conditions furthermore guarantees identical conditions in the coolant before the individual connection of the coolant tubes.

Yet the division of the mixing chamber by the connecting pieces arranged in rows does not lead to disturbing increases in resistance for the flowing coolant.

A still further object of the this invention is to construct the mixing chambers of flexible foils with the connecting pieces welded between the foils. An object of the invention is also to provide a garment wherein the manifold is substantially identical to the header with coolant flowing in opposite directions in the manifold and header. The construction of the inventive device from foils is marked by a high flexibility and hence good wearing comfort.

Another object of the invention is to provide such a garment wherein the coolant discharge and supply conduits are arranged in the mixing chambers at a level of the median axis of the mixing chambers for flow parallel to one of the opposite end walls of each of the mixing chambers. The pro-rated space requirement for the manifolds and headers can thus be further reduced where this is desirable.

A still further object of the invention is to provide a heat protection garment which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
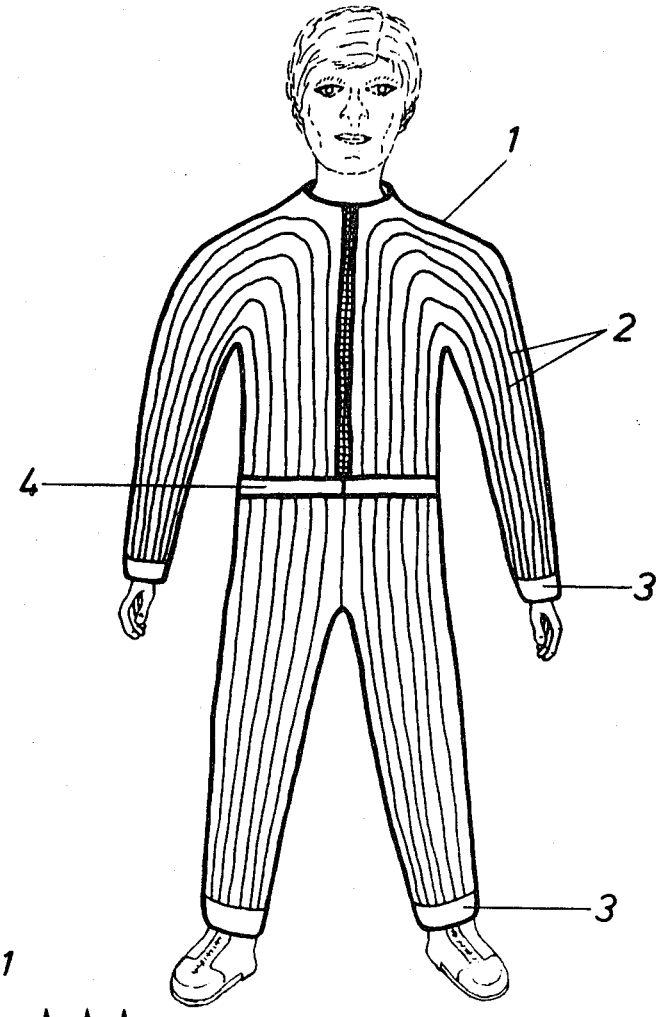
FIG. 1 is an elevational view of a heat protection garment according to the invention.

Referring to the drawing in particular the invention embodied therein, in FIG. 1, is a heat protection suit 1 equipped with coolant tubes 2. The coolant tubes 2 start at manifolds 3 and end in headers 4. According to FIG. 1, the manifolds 3 are located at the arms and legs and the headers 4 at the body center, that is, at the waist. The manifolds 3 and headers 4 may also be arranged oppositely or in still other ways. The manifolds 3 and headers 4 are of identical design, only the coolant conduction or flow in opposite. What will be said below concerning the manifold 3 applies analgously to the header 4.

Figure 2:
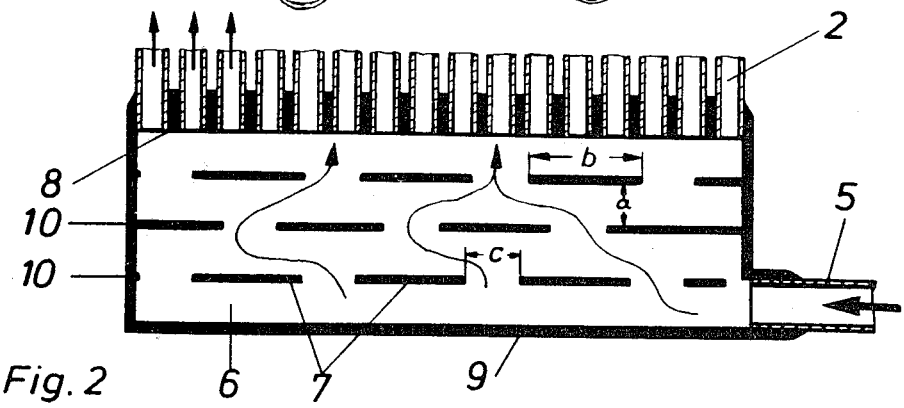
FIG. 2 is a sectional view of a manifold or header according to the invention.

The supply of the coolant tubes 2 extending parallel to each other and thus connected to the end wall 8 is effected via the pipe 5 functioning with an inflow parallel to the opposite end wall 9 and via a flow through the mixing chamber 6. See FIG. 2. The mixing chamber 6 consists of foils welded together. The opposite side walls of the mixing chamber 6 (in the plan of FIG. 2) are provided with a number of connecting pieces 7 resulting from longitudinal welds. The connecting pieces 7 having a length b are disposed in the same direction at a distance c in rows 10 one behind the other and with the cavity or spacing a of rows 10 side by side. By the connecting pieces 7 arranged parallel to the direction of flow from pipe 5 and by the rows 10 side by side, the coolant is forced to distribute itself over the full width of the mixing chamber, in order only then to enter the coolant tubes 2 in uniform distribution and hence in equal quantity.

A uniform distribution of the coolant is effected if, with A as the number of parallel coolant tubes 2, and B as the number of rows 10 of connecting pieces 7, and C as the number of pipes 5, the ratios approximately satisfy:

$$A:B:C \leqq 12:3:1$$

and $$a:b:c \leqq 1:3:1.$$

While a specific embodiment of the invention has been shown and described in detail to illustrate the application of the principles of the invention, it will be understood that the invention may be embodied otherwise without departing from such principles.

What is claimed is:

1. A heat protection garment comprising:

at least one manifold having opposite parallel end walls defining a mixing chamber;

at least one header having opposite parallel end walls defining a mixing chamber;

a plurality of coolant tubes connecting the manifold and header mixing chambers, the tubes connected to one end wall of each of the manifold and header;

at least one coolant supply conduit connected to the manifold mixing chamber at a location spaced from the coolant tubes connected thereto;

at least one coolant discharge conduit connected to the header mixing chamber at a location spaced from the coolant tubes connected thereto; and a plurality of parallel rows of connecting pieces extending across the manifold and header mixing chambers respectively, between the conduits and the coolant tubes and parallel to the end walls of the manifold and header respectively;

the ratio, in each of the manifold and header of the number of coolant tubes to the number of parallel rows of connecting pieces to the number of coolant conduits being approximately equal to or smaller than 12:3:1; and the ratio in each of the manifold and header of the spacing between the parallel rows of connecting pieces to the length of each connecting piece in each row to the spacing between each connecting piece ineach row being approximately equal to or less than 1:3:1.

2. A heat protection garment according to claim 1, wherein at least one coolant conduit for each mixing chamber is connected to the other of the opposite end walls for a flow of coolant parallel to the other of the opposite end walls.

3. A heat protection garment according to claim 2, wherein spaces between connecting pieces in each row are aligned with connecting pieces of an adjacent row.

4. A heat protection garment according to claim 1, wherein the at least one manifold is substantially the same in structure as the at least one header.

5. A heat protection garment according to claim 1, including connected arm, leg and body portions, at least one of the manifold and header positioned at an end of each of the leg and arm portions and the other of the manifold and header positioned at a central position of the body portion.

6. A heat protection garment according to claim 1, wherein the walls defining the mixing chambers of the manifold and header are made of flexible foils to which are welded the connecting pieces.

* * * * *